US010274203B2

(12) United States Patent
Luckhardt et al.

(10) Patent No.: US 10,274,203 B2
(45) Date of Patent: Apr. 30, 2019

(54) ARRANGEMENT OF GLASS PANELS FOR A HEAT INSULATED OVEN DOOR FOR A COOKING OVEN

(71) Applicant: Electrolux Home Products Corporation N.V., Brussels (BE)

(72) Inventors: Christoph Luckhardt, Rothenburg ob der Tauber (DE); Fabienne Reinhard-Herrscher, Rothenburg ob der Tauber (DE)

(73) Assignee: Electrolux Home Products Corporation N.V., Brussels (BE)

( * ) Notice: Subject to any disclaimer, the term of this patent is extended or adjusted under 35 U.S.C. 154(b) by 907 days.

(21) Appl. No.: 14/375,963

(22) PCT Filed: May 3, 2013

(86) PCT No.: PCT/EP2013/059287
§ 371 (c)(1),
(2) Date: Jul. 31, 2014

(87) PCT Pub. No.: WO2013/164464
PCT Pub. Date: Nov. 7, 2013

(65) Prior Publication Data

US 2015/0047624 A1 Feb. 19, 2015

(30) Foreign Application Priority Data

May 3, 2012 (EP) ..... 12166565

(51) Int. Cl.
*F24C 15/02* (2006.01)
*F24C 15/04* (2006.01)
*F24C 15/34* (2006.01)

(52) U.S. Cl.
CPC ..... *F24C 15/04* (2013.01); *F24C 15/021* (2013.01); *F24C 15/34* (2013.01)

(58) Field of Classification Search
None
See application file for complete search history.

(56) References Cited

U.S. PATENT DOCUMENTS 2,008,345 A * 7/1935 Blanchford ..... F24C 15/021 126/200
2,348,297 A * 5/1944 Huddle ..... E06B 3/66319 126/200

(Continued)

FOREIGN PATENT DOCUMENTS

CH 86804 10/1920
DE 4325399 2/1995

(Continued)

OTHER PUBLICATIONS

International Search Report for PCT/EP2013/059287, dated Mar. 20, 2013, 3 pages.

*Primary Examiner* — Avinash A Savani
*Assistant Examiner* — Martha M Becton
(74) *Attorney, Agent, or Firm* — Pearne & Gordon LLP

(57) ABSTRACT

The present invention relates to a arrangement of at least two glass panels (12, 14, 16) for a heat insulated oven door (10) of a cooking oven. The arrangement of the glass panels (12, 14, 16) is provided as or for a window of the oven door (10). The large-area sides of said glass panels (12, 14, 16) are arranged in parallel. Two neighbored glass panels (12, 14, 16) are arranged with a predetermined distance from each other, so that an intermediate space (24, 24', 24") is formed between said neighbored glass panels (12, 14, 16).

14 Claims, 6 Drawing Sheets

(56) References Cited

Figure 1:
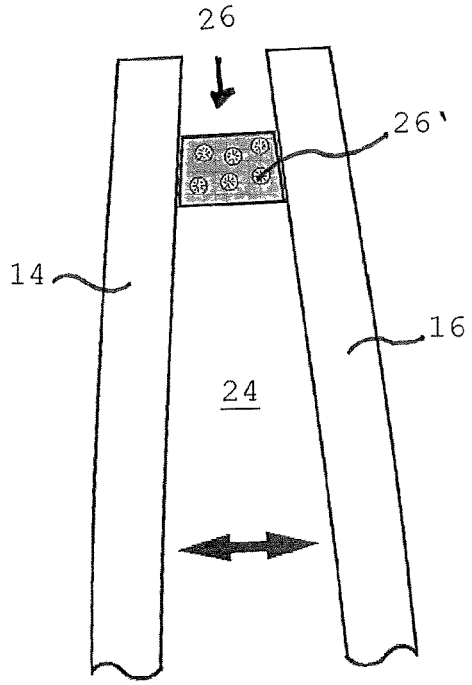

U.S. PATENT DOCUMENTS 2,575,655 A * 11/1951 Clerk ..... E06B 3/26336 49/DIG. 1
3,064,320 A * 11/1962 Blaszkowski ..... E06B 3/5871 118/503
3,168,089 A * 2/1965 Larkin ..... E06B 3/6621 126/200
3,200,812 A * 8/1965 Larkin ..... A21B 3/02 126/200
3,404,675 A * 10/1968 Payne ..... F24C 15/021 126/190
3,796,657 A * 3/1974 Pretorius et al. .. B01D 11/0242 210/198.2
4,253,286 A * 3/1981 Katona ..... F24C 15/04 126/198
4,536,424 A * 8/1985 Laurent ..... E06B 3/6715 156/107
4,604,840 A * 8/1986 Mondon ..... E06B 1/6015 52/172
4,683,154 A * 7/1987 Benson ..... C03B 23/245 156/107
4,835,926 A * 6/1989 King ..... E06B 3/677 428/34
5,482,552 A * 1/1996 Kikukawa ..... G03G 15/2025 118/264
5,588,421 A * 12/1996 Busch ..... F24C 15/34 126/190
6,359,026 B1 * 3/2002 Marquardt ..... C08J 9/0066 521/154
6,601,575 B2 * 8/2003 Gros ..... F24C 15/04 126/190
6,959,705 B2 * 11/2005 Briedis ..... F24C 15/04 126/190
7,155,869 B2 * 1/2007 Wildenhain ..... B32B 17/10036 403/115
8,173,942 B2 * 5/2012 Wiseman ..... H05B 6/6405 126/198
8,512,829 B2 * 8/2013 Cooper ..... E06B 3/6612 428/34
8,678,322 B2 * 3/2014 Long ..... B64G 1/423 244/158.1
8,750,776 B2 * 6/2014 Ogawa ..... G03G 15/2057 399/333
9,074,777 B2 * 7/2015 Catalogne ..... F24C 15/14
2003/0029440 A1 * 2/2003 Gros ..... F24C 15/04 126/200
2006/0180141 A1 * 8/2006 Schnell ..... F24C 15/04 126/200
2009/0151853 A1 * 6/2009 Cooper ..... E06B 3/6612 156/104
2009/0151854 A1 * 6/2009 Cooper ..... C03C 8/24 156/109
2009/0151855 A1 * 6/2009 Wang ..... C03C 27/06 156/109
2009/0155499 A1 * 6/2009 Cooper ..... E06B 3/6612 428/34
2012/0093551 A1 * 4/2012 Ogawa ..... G03G 15/2057 399/333
2012/0273622 A1 * 11/2012 Long ..... G21F 1/12 244/171.7
2013/0074821 A1 * 3/2013 Keller ..... F24C 15/34 126/198
2013/0220296 A1 * 8/2013 Catalogne ..... F24C 15/14 126/198
2016/0010874 A1 * 1/2016 Phillips ..... F24C 15/006 126/198

FOREIGN PATENT DOCUMENTS

| | | |
|---|---|---|
| DE | 102004011036 | 9/2005 |
| EP | 0646753 | 4/1995 |
| EP | 1860270 | 11/2007 |
| WO | 03039193 | 5/2003 |

* cited by examiner

ARRANGEMENT OF GLASS PANELS FOR A HEAT INSULATED OVEN DOOR FOR A COOKING OVEN

The present invention relates to an arrangement of at least two glass panels for a heat insulated oven door of a cooking oven. Further, the present invention relates to a heat insulated oven door for a cooking oven including an arrangement of glass panels. Additionally, the present invention relates to a cooking oven with a heat insulated oven door comprising an arrangement of glass panels.

An oven door of a cooking without any heat insulating devices causes a loss of energy, regardless of said oven door is actively ventilated in order to keep the temperature of the outer surface at a lower level. The loss of energy is very big, if the cooking oven provides a pyrolytic cleaning. The window of the oven door includes one or more glass panels. Said glass panels are heated up by the heat in the oven cavity. This heat is transferred to the surrounding air by convection. The different heat expansions of the components lead to instabilities.

DE 43 25 399 A1 discloses a system of glass panels. The intermediate spaces between said glass panels may be evacuated. The edge bond of the glass panel is vacuum-sealed. The system of glass panels is self-supporting.

DE 36 25 244 A1 discloses an oven door with two glass panels and an intermediate space between them. Said intermediate space comprises a vacuum and a cooling fluid.

US 2002/0007829 A1 discloses an insulating glass door for a cooking oven. The glass door comprises an interspace, which is at least partially filled with inert gas.

It is an object of the present invention to provide an improved arrangement of glass panels for a heat insulated oven door, wherein the instabilities by heat expansion is reduced.

The object of the present invention is achieved by the arrangement of at least two glass panels for a heat insulated oven door according to claim 1.

According to the present invention the silicone sealing and/or the glass solder, respectively, are adapted to the behaviour of the glass panels at high temperatures, so that motions of the glass panels due to heat expansion and/or gas pressure are compensated.

The main idea of the present invention is the properties of the silicone sealing and/or the glass solder, respectively, at high temperatures. For example, the silicone sealing maintains its elastic properties at high temperatures. Further, the structure of the glass solder may by adapted to the neighbored glass panels in order to compensate the different heat expansions of said glass panels.

According to a preferred embodiment of the present invention the large-area sides of the glass panels have the same sizes.

According to a first embodiment of the invention, the silicone sealing can be made of silicone foam. A silicone foam has important advantages when arranged according to the present invention in a suitable way to fill and seal the boarder of an intermediate space between two neighbouring glass panels of a heat insulated oven door of a cooking oven, wherein said intermediate space can be preferably filled with an inert gas, such as for example Argon.

An inner glass panel that faces the oven cavity can become very hot and its neighbouring glass panel that faces towards the outside can have a much lower temperature such as almost room temperature. Now, it has been found surprisingly that a silicone foam can tolerate better than any non-foamed silicone sealings of the prior art a temperature gradient between two neighbouring glass panels of an oven door. It has been found that a silicone foam sealing does not tear off from neighboring glass panels even after repeated exposure to steep temperature gradients between about 300° C. at the inner glass panel and close to room temperature at the neighbouring glass panel.

It has been found that in principle both, a silicone foam comprising essentially closed pores, or of a silicone foam comprising essentially open pores can be used according to the present invention. Since the closed pores are filled with a gas they will expand the volume of the sealing when heated and thus adapt the spacer to the form of the glass, avoid tearing off the sealing from the glass.

In the case of a silicone foam comprising open pores, the pores can adapt their sizes due to expanding gas that enters with pressure from an intermediate space between two neighbouring glass panels, wherein the intermediate space can be filled with an inert gas according to the present invention. In a preferred execution of the invention, the silicone foam sealing comprising open pores can have a gas barrier on its outside facing side that faces away from the intermediate space between the neighbouring glass panels, in particular when an open pore silicone foam sealing of a comparably small dimension is used. In that way, any loss of an inert gas filling of said intermediate space can be effectively avoided. But also an open pore silicone foam sealing without any gas barrier can be used to seal an intermediate space between two glass panels that is filled with an inert gas, if the sealing is formed as a solid part of sufficient dimensions that consists essentially of silicone foam without any further cavities.

For example, the silicone sealing is formed as an elongated profile strip.

According to a second embodiment of the invention, a heat insulated oven door for a cooking oven is provided that includes three glass panels that are arranged in parallel such that a first intermediate space and a second intermediate space are formed between neighbouring glass panels, wherein the border of the first intermediate space is sealed with a silicone sealing and the border of the second intermediate space is sealed with a glass solder. Said first intermediate space is preferably filled with an inert gas, whereas said second intermediate space is evacuated. Still preferably, said second intermediate space is arranged towards the oven cavity, whereas said first intermediate space faces outwards.

The evacuated second intermediate space that is sealed with glass solder can stand particularly high temperatures when arranged facing directly the oven cavity due to the high thermal stability of the glass solder as such. Yet, glass solder is not stable when used to bridge a large temperature gradient between two neighbouring glass panels that are arranged at an elevated distance from each other. Therefore, the effectiveness of the thermal isolation of a vacuumized arrangement of two glass panels that are sealed by glass solder is lower than that of a gas-filled arrangement of two glass panels.

The present invention has found that an arrangement of three glass panels that comprises a first intermediate space and a second intermediate space, wherein the border of the first intermediate space is sealed with a silicone sealing and the border of the second intermediate space is sealed with a glass solder, said first intermediate space is filled with an inert gas, whereas said second intermediate space is evacuated, and said second intermediate space is arranged towards the oven cavity, whereas said first intermediate space faces outwards provides a particularly high thermal isolation effectiveness and at the same time an enhanced stability of both sealings over time. In fact, said arrangement has been found to provide superior isolation effectiveness and thermal stability even in doors of pyrolytic ovens which comprise a pyrolytic cleaning functionality that heats the oven cavity to a temperature of about 500° C. in order to burn food residues on the inner cavity surface to ashes.

Further, a supporting structure can be arranged in the evacuated intermediate space. This contributes to the stability of the arrangement of glass panels. Because differently to oven doors with glass panel arrangements comprising a sealed and gas-filled intermediate space wherein the gas expands when the oven cavity is heated, the glass panel of an evacuated glass panel arrangement that faces the oven cavity will be pressed towards the outer glass panel during heating, potentially damaging the glass solder and leading in addition to extended contact areas between both glass panels and hence to a reduction of the insulation effectiveness.

For example, the supporting structure includes at least one elongated profile strip. Preferably, the supporting structure is made of silicone foam.

Alternatively, the supporting structure includes a plurality of supporting elements.

For example, the supporting elements are glass beads.

According to another example, the supporting elements may be glass cylinders.

Preferably, the supporting elements can be arranged according a predetermined scheme and form a grid.

Further, the present invention relates to a heat insulated oven door for a cooking oven including an arrangement of glass panels, wherein the oven door includes the arrangement of at least two glass panels mentioned above.

At last, the present invention relates to a cooking oven with a heat insulated oven door comprising an arrangement of glass panels, wherein the oven door includes the arrangement of at least two glass panels mentioned above and/or the cooking oven includes the oven door described above.

Novel and inventive features of the present invention are set forth in the appended claims.

Figure 2:
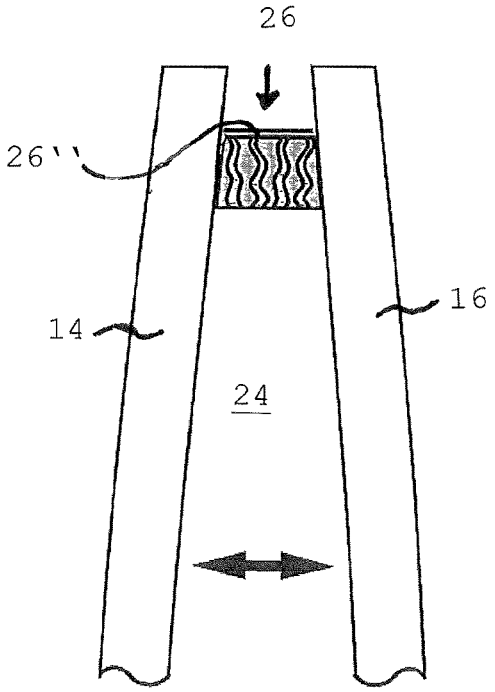
Figure 3:
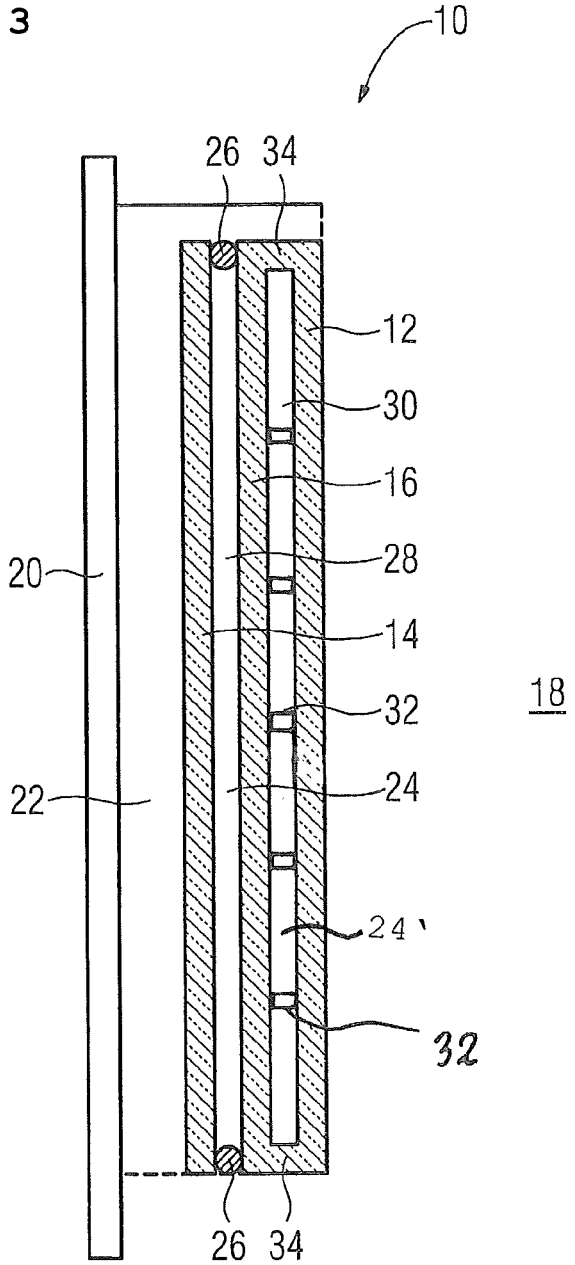
Figure 4:
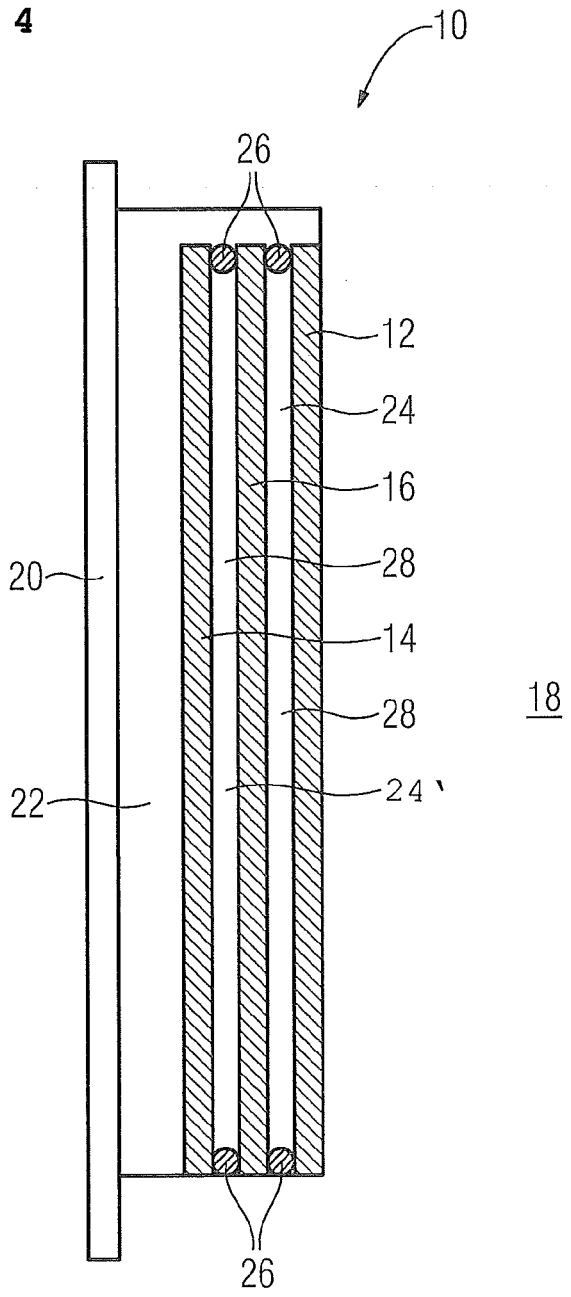
Figure 5:
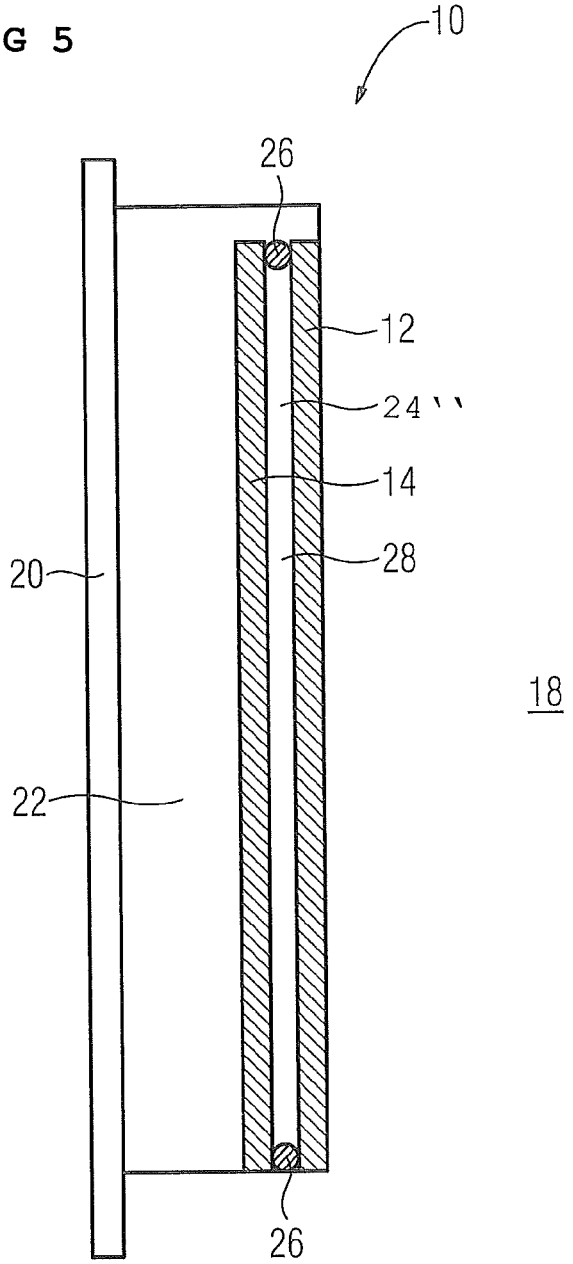
Figure 6:
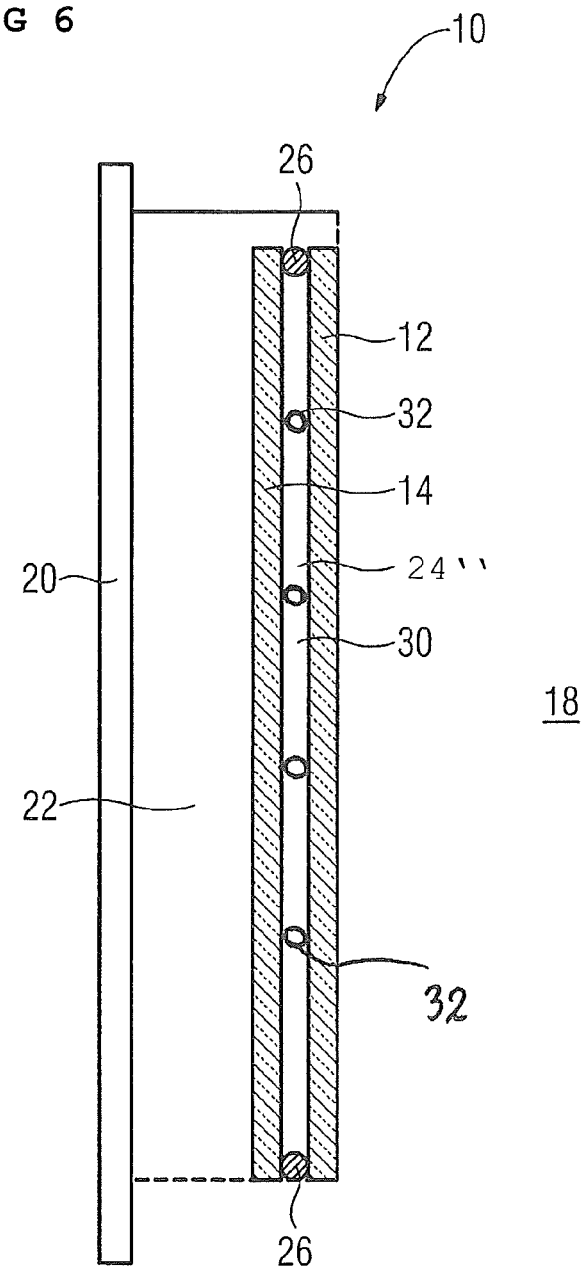
Figure 7:
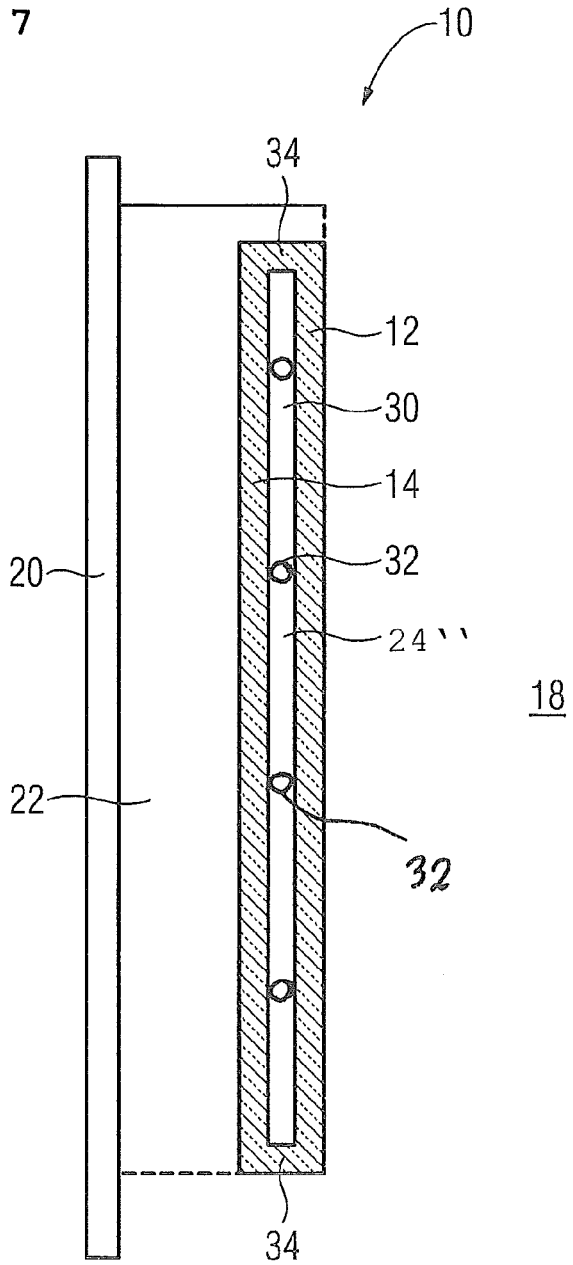

The present invention will be described in further detail with reference to the drawing, in which FIG. 1 illustrates a schematic sectional side view of a part of an arrangement of two glass panels according to the first embodiment of the present invention, FIG. 2 illustrates a schematic sectional side view of an alternative execution of the first embodiment of the present invention, FIG. 3 illustrates a schematic sectional side view of the oven door with the arrangement of the glass panels according to the second embodiment of the present invention, and FIG. 4 illustrates a schematic sectional side view of an oven door with an arrangement of glass panels according to a third embodiment of the present invention, FIG. 5 illustrates a schematic sectional side view of the oven door with the arrangement of the glass panels according to a fourth embodiment of the present invention, FIG. 6 illustrates a schematic sectional side view of the oven door with the arrangement of the glass panels according to a fifth embodiment of the present invention, FIG. 7 illustrates a schematic sectional side view of the oven door with the arrangement of the glass panels according to a sixth embodiment of the present invention.

FIG. 1 illustrates a schematic sectional side view of a part of an arrangement of two glass panels according to the first embodiment of the invention. A silicone sealing 16 which is formed as a closed pore silicone foam is arranged to seal the border between the upper edges of—from left to right—two neighbouring glass planes 14 and 16. The intermediate space 24 enclosed by the glass planes 14 and 16, the silicone sealing 16 and a corresponding sealing 16 at the lower edges of said glass planes (not shown) represent schematically a situation where heat has been applied to the arrangement which has lead to a thermal expansion of the inert gas that is comprised in the intermediate space 24 and hence to an outwardly bending of both glass planes 14 and 16 relative to the intermediate space 24. The schematical drawing shows in principle the corresponding deformation of the silicone sealing 16 which is compressed at its upper end and stretched at its lower end—with corresponding stresses on its adhesive contacts to the glass planes 14 and 16. The closed pores 26' indicated schematically inside the silicone sealing 16 illustrate its closed pore structure. As can be easily understood, the closed gas pores 26' allow the adaptation of the sealing 26 to the deformation of the glass planes 14, 16, which effect is further supported by the thermal volume alteration of the gas enclosed inside the gas pores 26'.

FIG. 2 shows a variant of the first embodiment of FIG. 1, wherein however the pores 26" of the foamed silicone sealing 26 are open. In the example shown, wherein the foamed silicone spacer 26 comprising the open pores 26" is relatively thin, a gas barrier 26''' which is provided on the outer surface of the sealing 26 can support effectively avoiding any losses of the inert gas filling of the intermediate space 24.

FIG. 3 illustrates a schematic sectional side view of the oven door 10 with the arrangement of the glass panels 12, 14 and 16 according to a second embodiment of the present invention. The arrangement of the second embodiment includes three glass panels 12, 14 and 16.

The inner glass panel 12 is arranged towards the oven cavity 18. The outer glass panel 14 is arranged behind the front panel 20 of the oven door 10. The front space 22 between the outer glass panel 14 and the front panel 20 of the oven door 10 is open in order to allow an air flow space inside said front space 22, so that the front space 22 forms an air stream channel for cooling an outer portion of the oven door 10. The central glass panel 16 is arranged between the inner glass panel 12 and the outer glass panel 14. In this example, the inner glass panel 12, the outer glass panel 14 and the central glass panel 16 have the same areas and thicknesses.

A first intermediate space 24 is arranged between the outer glass panel 14 and the central glass panel 16 on the one hand, and a further second intermediate space 24' is arranged between the central glass panel 16 and the inner glass panel 12 on the other hand.

The border of the first intermediate spaces 24 between the outer glass panel 14 and the central glass panel 16 is filled by the silicone sealing 26, so that the silicone sealing 26 encloses said first intermediate space 24. Further, the first intermediate space 24 is filled by the inert gas 28, such as for example Argon.

In contrast, the border of the further second intermediate space 24' between the central glass panel 16 and the inner glass panel 12 is filled by a glass solder 34. Said glass solder 34 encloses the second intermediate space 24'. The vacuum 30 and the supporting structure are inside the further intermediate space 24'.

The second intermediate space 24' comprises the supporting structure 32 that includes the plurality of supporting elements. In this example, the supporting elements are small glass cylinders. The bases of the cylinders lie against the glass panels 12 and 16, while the curved surfaces of the cylinders are in the second intermediate space 24' between the glass panels 12 and 16. The glass cylinders are distributed in the second intermediate space 24' between the glass panels 12 and 16 according to a predetermined scheme. For example, the glass cylinders are equally distributed and form a grid. The distances between horizontally neighbored glass cylinders and vertically neighbored glass cylinders may be different or equal. Alternatively, the supporting elements may be the small glass beads arranged between the glass panels 12 and 16. The supporting structure allows an increased stability of the inner glass panel 12 and the central glass panel 16 enclosing the vacuum 30 in the second intermediate space 24'.

FIG. 4 illustrates a schematic sectional side view of an oven door 10 with an arrangement of glass panels 12, 14 and 16 according to a third embodiment of the present invention. The arrangement of the third embodiment includes three glass panels 12, 14 and 16.

An inner glass panel 12 is arranged towards an oven cavity 18. An outer glass panel 14 is arranged behind a front panel 20 of the oven door 10. There is a front space 22 between the outer glass panel 14 and the front panel 20 of the oven door 10. Preferably, the front space 22 is open in order to allow an air flow space inside said front space 22. Thus, the front space 22 may be provided as an air stream channel for cooling an outer portion of the oven door 10.

A central glass panel 16 is arranged between the inner glass panel 12 and the outer glass panel 14. In this example, the inner glass panel 12, the outer glass panel 14 and the central glass panel 16 have the same areas and thicknesses. A first intermediate space 24 is arranged between the outer glass panel 14 and the central glass panel 16. In a similar way, a further second intermediate space 24' is arranged between the central glass panel 16 and the inner glass panel 12. In this example, said intermediate spaces 24, 24' have the same thicknesses. Further, the glass panels 12, 14 and 16 and the intermediate spaces 24, 24' have about the same thicknesses.

The borders of the intermediate spaces 24, 24' are filled by a silicone sealing 26 in each case, so that the silicone sealings 26 enclose the corresponding intermediate spaces 24, 24'. Moreover, the intermediate spaces 24, 24' are filled by an inert gas 28, such as for example Argon.

FIG. 5 illustrates a schematic sectional side view of the oven door 10 with the arrangement of the glass panels 12 and 14 according to a fourth embodiment of the present invention. The arrangement of the fourth embodiment includes two glass panels 12 and 14.

The inner glass panel 12 is arranged towards the oven cavity 18. The outer glass panel 14 is arranged behind the front panel 20 of the oven door 10. There is the open front space 22 between the outer glass panel 14 and the front panel 20 of the oven door 10, in order to allow the air flow inside said front space 22 for cooling the outer portion of the oven door 10.

A single intermediate space 24" is arranged between the inner glass panel 12 and the outer glass panel 14. In this example, the single intermediate spaces 24" has about the same thickness as the glass panels 12 and 14. The border of the single intermediate space 24" is filled by the silicone sealing 26, so that the silicone sealing 26 encloses said single intermediate space 24". Further, the single intermediate space 24" is filled by the inert gas 28, such as for example Argon.

FIG. 6 illustrates a schematic sectional side view of the oven door 10 with the arrangement of the glass panels 12 and 14 according to a fifth embodiment of the present invention. The arrangement of the fifth embodiment includes two glass panels 12 and 14.

The inner glass panel 12 is arranged in front of the oven cavity 18. The outer glass panel 14 is arranged behind the front panel 20 of the oven door 10. There is also the open front space 22 between the outer glass panel 14 and the front panel 20 of the oven door 10, in order to allow the air flow inside said front space 22 for cooling the outer portion of the oven door 10.

A single intermediate space 24" is arranged between the inner glass panel 12 and the outer glass panel 14. In this example, the single intermediate space 24" has also about the same thickness as the glass panels 12 and 14. The border of the single intermediate space 24" is filled by the silicone sealing 26, so that the silicone sealing 26 encloses said single intermediate space 24". In this embodiment, a vacuum 30 is inside the single intermediate space 24". Further, a supporting structure 32 is arranged in the single intermediate space 24". Said supporting structure 32 allows an increased stability of the inner glass panel 12 and the outer glass panel 14 enclosing the vacuum 30 in the single intermediate space 24".

The supporting structure 32 includes a plurality of supporting elements. In this example, said supporting elements are small glass beads. The glass beads are arranged between the glass panels 12 and 14. The glass beads are distributed in the single intermediate space 24" according to a predetermined scheme. For example, the glass beads are equally distributed and form a grid. The distances between horizontally neighbored glass beads and vertically neighbored glass beads may be different or equal. Alternatively, the supporting elements may be small glass cylinders. In this case, the bases of the cylinders lie against the glass panels 12 and 14, while the curved surfaces of the cylinders are in the single intermediate space 24".

FIG. 7 illustrates a schematic sectional side view of the oven door 10 with the a sixth embodiment of the present invention. The arrangement of the sixth embodiment includes two glass panels 12 and 14.

The inner glass panel 12 is arranged in front of the oven cavity 18. The outer glass panel 14 is arranged behind the front panel 20 of the oven door 10. A single intermediate space 24" is arranged between the outer glass panel 14 and the inner glass panel 12. There is also the open front space 22 between the outer glass panel 14 and the front panel 20 of the oven door 10, in order to allow the air flow inside said front space 22 for cooling the outer portion of the oven door 10.

The border of the single intermediate space 24" between the outer glass panel 14 and the inner glass panel 12 is filled by the glass solder 34. Said glass solder 34 encloses the single intermediate space 24". The vacuum 30 and the supporting structure 32 are inside the single intermediate space 24". The supporting structure allows an increased stability of the inner glass panel 12 and the outer glass panel 14 enclosing the vacuum 30 in the single intermediate space 24".

The supporting structure 32 includes the plurality of supporting elements arranged between the glass panels 12 and 14. In this example, said supporting elements are small glass beads again. The glass beads are distributed in the single intermediate space 24" according to a predetermined scheme. For example, the glass beads are equally distributed and form a grid. The distances between horizontally neighbored glass beads and vertically neighbored glass beads may be different or equal. Alternatively, the supporting elements may be also small glass cylinders. In this case, the bases of the cylinders lie against the glass panels 12 and 14, while the curved surfaces of the cylinders are in the single intermediate space 24".

The first, second and/or single intermediate spaces 24, 24' or 24" with vacuum or inert gas reduce the heat conductivity of the arrangement of glass panels 12, 14 and/or 16. The temperature gradient at the glass panels 12, 14 and/or 16 is reduced. The cooking results are improved, since uneven browning is prevented. The energy consumption is lower, since the heat conductivity is reduced. The arrangement of the glass panels 12, 14 and/or 16 can easily be mounted into the oven door 10. When the oven door 10 is closed, then the acoustic characteristics are improved by the arrangement of the glass panels 12, 14 and/or 16.

Further, the thermal impact and the pressure impact on the silicon sealing are reduced. The silicone sealing 26 as well as the glass solder 34 are adapted to the thermal behaviour of the glass panels 12, 14 and/or 16. The silicone sealing 26 may be made of silicone foam, so that the stability is improved, when the glass panels 12, 14 and/or 16 are deformed at high temperatures. In particular, the glass solder 34 can compensate the different heat expansions of the glass panels 12, 14 and/or 16.

Unlike double or triple window panes as used for buildings, the glass panels 12, 14 and 16 do not require any drying agents, e.g. a molecular sieve, in the intermediate spaces 24.

The glass panels 12, 14 and 16 as well as the glass panels 14 and 16 with the solder 34 have been tempered. In order to prevent an outgassing of the silicone sealing 26, the supporting structure 32 or other spacers, the tempering has been performed for a relative long time.

If low-energy panels are used, then preferably a scavenger is applied in order to absorb highly volatile components. For example, diatomaceous earth is used as scavenger.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 inner glass panel
14 outer glass panel
16 central glass panel
18 oven cavity
20 front panel
22 front space
24 first intermediate space
24' second intermediate space
24" single intermediate space
26 silicone sealing
26' closed pore of foamed silicone sealing
26" open pore of foamed silicone sealing
26''' gas barrier on the outside of the open pore foamed silicone sealing
28 inert gas
30 vacuum
32 supporting structure
34 glass solder

The invention claimed is:

1. A cooking oven comprising:
an oven cavity; and
an oven door including a front panel facing an ambient environment and an arrangement of at least three glass panels,
the arrangement of the glass panels being provided as or for a window of the oven door, large-area sides of said glass panels being arranged in parallel,
the glass panels being arranged a predetermined distance from each other, so that a first intermediate space and a second intermediate space are formed between adjacent glass panels,
a border of the first intermediate space being filled with a silicone sealing and a border of the second intermediate space being filled with a glass solder,
the first intermediate space and the second intermediate space being evacuated or filled with an inert gas,
the silicone sealing and/or the glass solder, respectively, being adapted to the behaviour of the glass panels at high temperatures to compensate for motions of the glass panels due to heat expansion and/or gas pressure, and
an inner glass panel of the at least three glass panels closing an open end of the oven cavity while the oven door is in a closed position.

2. The cooking oven according to claim 1, wherein
the large-area sides of the glass panels have essentially the same sizes.

3. The cooking oven according to claim 1, wherein
the silicone sealing is made of silicone foam.

4. The cooking oven according to claim 3,
the silicone foam comprising essentially closed pores.

5. The cooking oven according to claim 3,
said silicone foam comprising essentially open pores.

6. The cooking oven according to claim 5, wherein
the silicone sealing is formed as a solid part, said silicone foam consisting essentially of open pores.

7. The cooking oven according to claim 5, wherein
the silicone sealing consists essentially of silicone foam comprising open pores and comprises a gas barrier on a side that faces away from the first intermediate space or the second intermediate space between the adjacent glass panels.

8. The cooking oven according to claim 1, wherein
the silicone sealing is formed as an elongated profile strip.

9. The cooking oven according to claim 1, wherein
said first intermediate space is filled with an inert gas and said second intermediate space is evacuated.

10. The cooking oven according to claim 1, wherein said second intermediate space is arranged towards the oven cavity.

11. The cooking oven according to claim 1, wherein
a supporting structure is arranged in the evacuated second intermediate space.

12. The cooking oven according to claim 11, wherein
the supporting structure includes a plurality of supporting elements comprising glass beads or glass cylinders.

13. The cooking oven according to claim 12, wherein
the supporting elements are arranged according to a predetermined scheme and form a grid.

14. The cooking oven according to claim 1, wherein an outer glass panel of the at least three glass panels is arranged behind the front panel of the oven door.

* * * * *